US006900405B2

(12) United States Patent
Abraham et al.

(10) Patent No.: US 6,900,405 B2
(45) Date of Patent: May 31, 2005

(54) SEALED CIRCUIT BREAKER WITH PUSH-PULL ACTUATION

(75) Inventors: Gerd Abraham, Burgthann (DE); Ewald Schneider, Offenhausen (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 0 days.

(21) Appl. No.: 10/701,739

(22) Filed: Nov. 5, 2003

(65) Prior Publication Data

US 2004/0095700 A1 May 20, 2004

(30) Foreign Application Priority Data

Nov. 15, 2002 (DE) ..... 102 53 597

(51) Int. Cl.[7] ..... H01H 15/24
(52) U.S. Cl. ..... 200/538; 200/540; 200/334
(58) Field of Search ..... 200/523, 537, 200/538, 539, 540, 329–330, 334, 341

(56) References Cited

U.S. PATENT DOCUMENTS 5,605,225 A * 2/1997 Schaeffer ..... 200/539
5,945,647 A * 8/1999 Hoskins ..... 200/18
6,444,932 B1 * 9/2002 Resmalm ..... 200/334
6,483,062 B1 * 11/2002 Herdegen et al. ..... 200/538
6,570,105 B1 * 5/2003 Sallam et al. ..... 200/4
6,710,695 B1 * 3/2004 Pellon et al. ..... 337/66

FOREIGN PATENT DOCUMENTS

| | | |
|---|---|---|
| DE | 90 06 428.3 | 10/1990 |
| DE | 41 09 288 C2 | 9/1992 |
| DE | 693 19 220 T2 | 8/1994 |
| DE | 201 16 502 U1 | 2/2002 |
| EP | 0 613 160 A2 | 8/1994 |

* cited by examiner

*Primary Examiner*—Richard K. Lee
(74) *Attorney, Agent, or Firm*—Laurence A. Greenberg; Werner H. Stemer; Ralph E. Locher

(57) ABSTRACT

A circuit breaker has a threaded collar fixed on a breaker housing and an approximately cylindrical actuating element displaceably guided in a bore of the threaded collar and partially protruding from the breaker housing for manual push-pull actuation in an advantageous way on the actuating side. In order to seal the circuit breaker, a sealing ring seals an annular gap formed between the wall of the bore and the circumference of the actuating element.

2 Claims, 2 Drawing Sheets

SEALED CIRCUIT BREAKER WITH PUSH-PULL ACTUATION

BACKGROUND OF THE INVENTION

Field of the Invention

The invention relates to a circuit breaker, in particular for use in aircraft or spacecraft equipment, with a threaded collar fixed on the breaker housing and an approximately cylindrical actuating element displaceably guided in a bore of the threaded collar and partially protruding from the breaker housing. The actuating element being mechanically connected to a switching mechanism in such a way that the switching mechanism is adjustable between a closed position and an open position by manual pushing or pulling of the actuating element.

Such circuit breakers are commonly used in particular in aviation and aerospace technology and have to conform to national and international standards. Known to exist are single-pole configurations, which are described for example in DIN EN 2495, MS 3320 (US) and VG 95345-6, and multi-pole configurations for the simultaneous switching of multi-conductor networks, which are described for example in VG 95356-11 and AS 14154 (US). Circuit breakers of this type are fitted in aircraft and in the cockpit area as well as outside the pressurized cabin, for example in the landing gear. The circuit breakers used here must always remain operational even under adverse environmental conditions, such as changing atmospheric pressure and changing temperatures, in particular low temperatures. In this respect, it must be ensured in particular that any ingress of condensate and solid particles, such as for example dust or soot, into the breaker housing is prevented.

It is known from the standard VG 95345-23 to use an additional protective cap for sealing a circuit breaker in the area of its actuating element. The protective cap is in this case screwed onto the threaded collar of the circuit breaker in place of a customary fastening nut and contains a flexible sealing element which either completely encloses the part of the actuating element protruding from the breaker housing or fits snugly around the circumference of the actuating element in the manner of an annular lamella. In a disadvantageous way, the sealing element of the known protective caps is itself disposed in a permanently unprotected way on the surface of the circuit breaker that is visible and can be touched. The sealing element is consequently exposed not only to adverse environmental influences but also possibly to mechanical loading, for example by an installation tool, so that mechanical damage to the sealing element is not ruled out. In addition, the circuit breaker is only sealed as long as the protective cap is firmly screwed on it. In particular, proper functioning of the circuit breaker is only ensured if the mounting of the protective cap is properly performed.

SUMMARY OF THE INVENTION

It is accordingly an object of the invention to provide a sealed circuit breaker with push-pull actuation that overcomes the above-mentioned disadvantages of the prior art devices of this general type.

With the foregoing and other objects in view there is provided, in accordance with the invention, a circuit breaker. The circuit breaker contains a breaker housing, a switching mechanism disposed in the breaker housing, a threaded collar fixed on the breaker housing and has a wall and a bore formed therein delimited by the wall, and a substantially cylindrical actuating element displaceably guided in the bore of the threaded collar and partially protruding from the breaker housing. The actuating element is mechanically connected to the switching mechanism for toggling the switching mechanism between a closed position and an open position by manual pushing or pulling the actuating element. A space between the wall of the bore and a circumference of the actuating element defines an annular gap. A sealing ring is provided for sealing the annular gap.

Accordingly, in the case of a circuit breaker of the generic type, a sealing ring that is disposed between the wall of the bore provided in the threaded collar of the circuit breaker and the circumference of the actuating element is provided and seals the annular gap formed there.

The sealing ring has the effect of protecting the circuit breaker in a simple way on the actuating side from splash water and condensate and also from penetrating contamination. The sealing ring is advantageously fitted already during the production of the circuit breaker. The circuit breaker is consequently already sealed in itself before installation, for example in an aircraft, thereby avoiding possible sources of error due to incorrect mounting or installation errors. Furthermore, the sealing ring is concealed in the threaded collar of the circuit breaker and consequently protected from damaging external access.

In a preferred configuration of the circuit breaker, the sealing ring lies in an annular groove of the actuating element and is consequently held in a non-slip manner on the circumference of the actuating element. This makes particularly simple production of the circuit breaker possible. In an equivalent way, however, the sealing ring may also lie in a groove alternatively provided in the threaded collar, and consequently be held on the threaded collar. The actuating element expediently contains a basic body, onto the circumference of which a marking ring and an end ring, disposed toward the inside of the housing from the latter, are pushed. The marking ring, which is made to be of a different color than the basic body, in particular white, is in this case only visible from the outside if the actuating element and the switching mechanism connected to it are in the open position. Such a switching position indication has already been described in the aforementioned standards. The marking ring and the end ring are in this case advantageously used for forming the annular groove, in that they are pushed onto the basic body with a spacing and receive the sealing ring between them.

Other features which are considered as characteristic for the invention are set forth in the appended claims.

Although the invention is illustrated and described herein as embodied in a sealed circuit breaker with push-pull actuation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
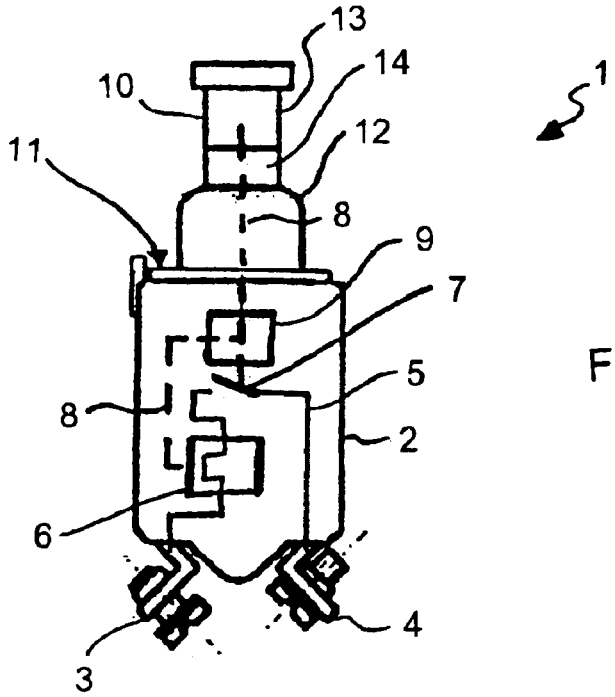
FIG. 1 is a diagrammatic, representation of a circuit breaker with an actuating element for manual push-pull actuation in an open position according to the invention.

In all the figures of the drawing, sub-features and integral parts that correspond to one another bear the same reference symbol in each case. Referring now to the figures of the drawing in detail and first, particularly, to FIGS. 1 and 2 thereof, there is shown a circuit breaker 1, which is intended for use in aircraft or spacecraft equipment. Reference is expressly made to the disclosure of the standards relevant to such a circuit breaker 1, DIN EN 2495, VG 95345-6, VG 95345-11, MS 3320 and AS 14154.

The circuit breaker 1 contains a breaker housing 2 formed of an insulating material, from which at least one pair of terminal contacts 3 and 4 protrude. By electrical contacting of the terminal contacts 3 and 4 with non-illustrated conductors of a circuit to be protected, the circuit breaker 1 is connected in the way intended into the circuit to be protected.

Figure 2:
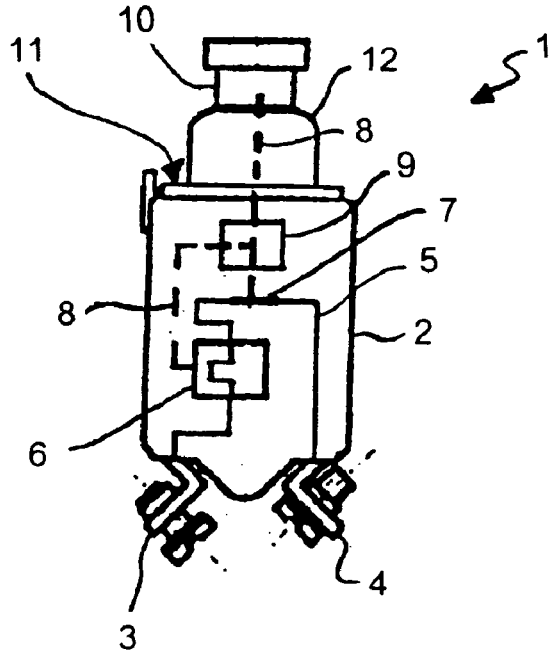
FIG. 2 is a representation of the circuit breaker according FIG. 1 with the circuit breaker in the closed position.

The circuitry of the circuit breaker 1 is schematically represented in FIGS. 1 and 2. The terminal contacts 3 and 4 are connected in an interior of the breaker housing 2 via a current path 5, in which a trip 6 and a switching contact 7 are incorporated.

In normal operation of the circuit breaker 1, the switching contact 7 is closed, so that a current flow between the terminal contacts 3 and 4 is made possible. If there is an electrical overload in the current path 5, the trip 6 actuates a switching mechanism 8, which is only indicated. The switching mechanism 8 contains a latching mechanism 9, which opens the switching contact 7. The circuit breaker 1 thereby switches from the closed position, represented in FIG. 2, into the open position, represented in FIG. 1, in which the conducting connection between the terminal contacts 3 and 4 is interrupted.

For the manual actuation of the circuit breaker 1, it has an approximately cylindrical actuating element 10, which partially protrudes from the breaker housing 2 on an upper side 11 of the housing opposite from the terminal contacts 3 and 4. The actuating element 10 is in this case displaceably guided in an approximately hollow-cylindrical threaded collar 12, which bears an external thread (not represented any more specifically) and, as described in more detail in the aforementioned standards, is provided together with a non-illustrated fastening nut for screwing the circuit breaker on a non-illustrated installation plate. The actuating element 10 is mechanically connected captively to the switching mechanism 8, in particular riveted, and protrudes further from the breaker housing 2 in the open position represented in FIG. 1 than in the closed position represented in FIG. 2. To identify the switching position of the circuit breaker 1, the actuating element 10 is provided with a marking ring 14, which has been pushed onto the circumference of a basic body 13 and is disposed with respect to the basic body 13 in such a way that it is visible from the outside only in the open position of the circuit breaker 1, while it is covered over by the threaded collar 12 in the closed position. The marking ring 14 is made to be of a different color than the basic body 13, in particular white, and consequently serves for the conspicuous identification of the switching position of the circuit breaker 1. By manually exerting pressure on the actuating element 10, the latter can be made to move from the open position into the closed position, the switching contact 7 being closed by the actuating element 10 interacting with the switching mechanism 8. Similarly, the actuating element 10 can be re-set from the closed position into the open position by manual pulling the actuating element 10, the switching contact 7 in turn being opened by way of the switching mechanism 8.

Figure 4:
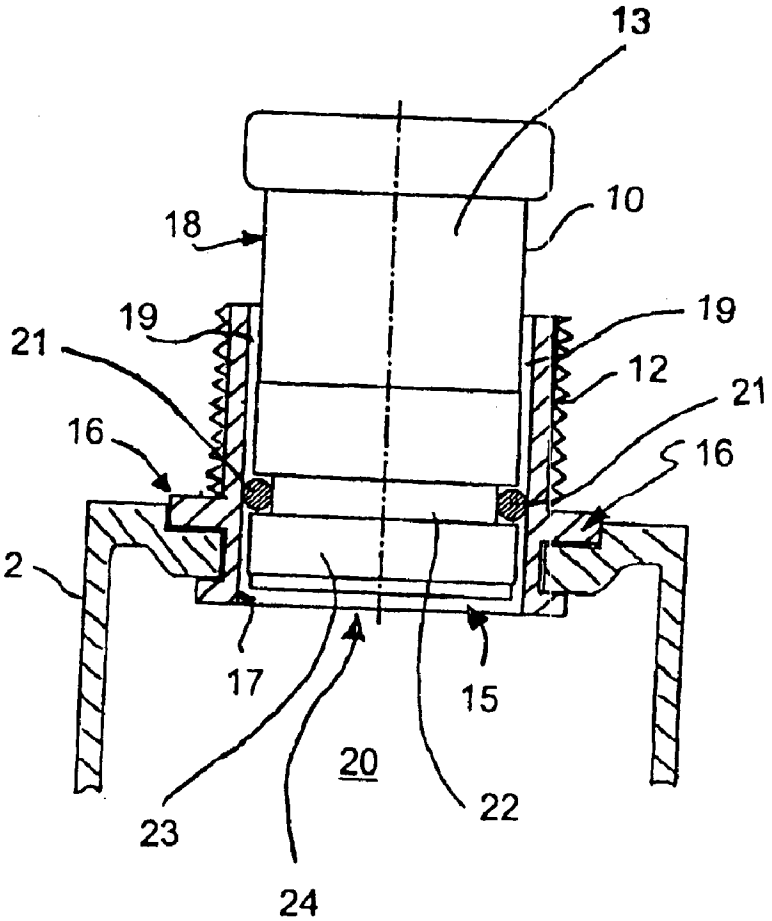
FIG. 4 is a cross-sectional view through the breaker housing according to FIG. 3 with the actuating element in the closed position.
Figure 3:
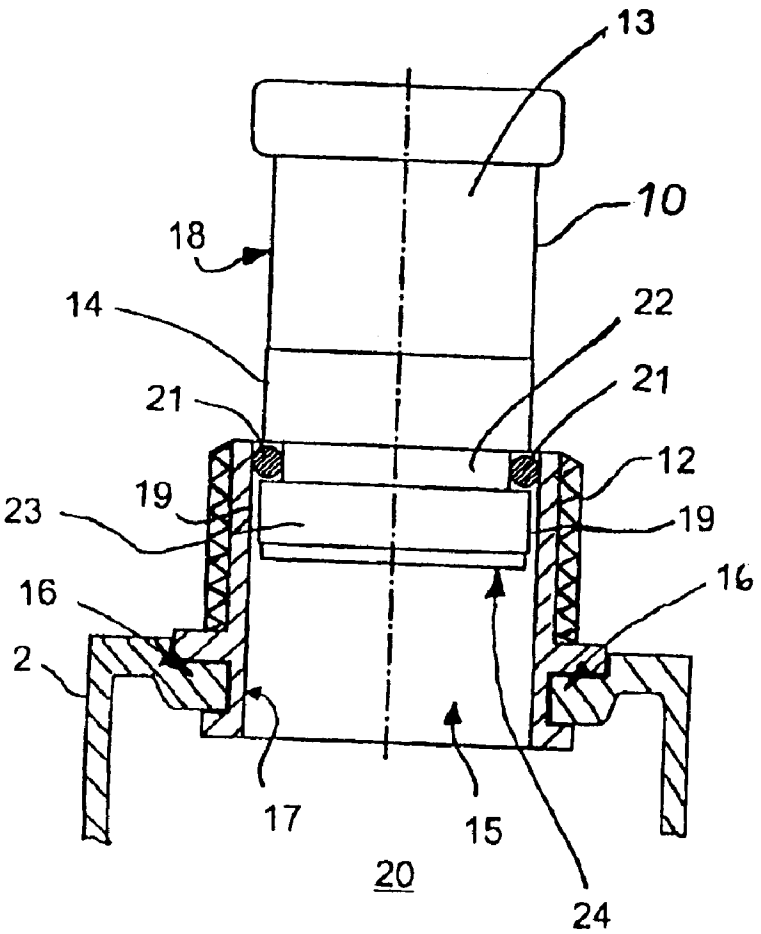
FIG. 3 is a cross-sectional view through the breaker housing of the circuit breaker with the actuating element in the open position.

In FIGS. 3 and 4, the actuating element 10 is respectively represented in the open position and in the closed position, in a section through the housing. It is particularly evident from this that the actuating element 10 lies in a bore 15 of the threaded collar 12. The threaded collar 12 is fixed with a form fit on the breaker housing 2 by tongue-and-groove construction 16. Because of the play required to allow the actuating element 10 to move with respect to the threaded collar 12, an annular gap 19 is formed between a wall 17 of the bore 15 and a circumference 18 of the actuating element 10. In order to prevent any ingress of water or contaminating particles through the annular gap 19 into an interior space 20 of the breaker housing 2, a sealing ring 21 is provided, disposed between the wall 17 and the circumference 18 and consequently closing the annular gap 19 in a sealing manner. The sealing ring 21 in this case lies in an annular groove 22 formed into the circumference 18 and is consequently held such that it is fixed in its position with respect to the actuating element 10. In other words, when there is a movement of the actuating element 10 with respect to the threaded collar 12, the sealing ring 21 is moved along with it. For forming the annular groove 22, in addition to the marking ring 14, an end ring 23 is pressed onto a basic body 13 from an inner side 24 of the actuating element 10 in such a way that between the marking ring 14 and the end ring 23 there is a spacing, in which the sealing ring 21 lies.

We claim:

1. A circuit breaker, comprising:

a breaker housing;

a switching mechanism disposed in said breaker housing;

a threaded collar fixed on said breaker housing and having a wall and a bore formed therein delimited by said wall;

a substantially cylindrical actuating element displaceably guided in said bore of said threaded collar and partially protruding from said breaker housing, said actuating element mechanically connected to said switching mechanism for toggling said switching mechanism between a closed position and an open position by manual pushing or pulling said actuating element, a space between said wall of said bore and a circumference of said actuating element defining an annular gap; and a sealing ring sealing said annular gap;

said actuating element having a basic body, a marking ring pushed onto a circumference of said basic body, and an end ring pushed onto said circumference of said basic body and disposed toward an inside of said breaker housing with respect to said marking ring, said marking ring and said end ring being disposed in relation to each other with a spacing, and said sealing ring lying between said marking ring and said end ring.

2. The circuit breaker according to claim 1, wherein said actuating element has an annular groove formed therein and said sealing ring lies in said annular groove of said actuating element.

* * * * *